US006006483A

United States Patent [19]

Lee

[11] Patent Number: 6,006,483

[45] Date of Patent: Dec. 28, 1999

[54] DECK PANEL FOR REINFORCED CONCRETE SLABS

[75] Inventor: Moon-Gon Lee, Seoul, Rep. of Korea

[73] Assignee: Haedong Metal Co., Ltd., Seoul, Rep. of Korea

[21] Appl. No.: 09/030,324

[22] Filed: Feb. 25, 1998

[30] Foreign Application Priority Data

Feb. 28, 1997 [KR] Rep. of Korea ..... 97-3542

[51] Int. Cl.[6] ..... E04B 1/18; E04B 1/20

[52] U.S. Cl. ..... 52/414; 52/319; 52/335; 52/336; 52/337; 52/600; 52/630; 52/649.1; 52/694

[58] Field of Search ..... 52/414, 649.1, 52/319, 600, 694, 335, 336, 337, 630

[56] References Cited

U.S. PATENT DOCUMENTS 3,930,349 1/1976 Wellerhaus ..... 52/694 X
4,386,489 6/1983 Sheahan ..... 52/694
5,054,964 10/1991 Salzmann et al. ..... 52/694 X
5,235,791 8/1993 Yaguchi ..... 52/414 X

*Primary Examiner*—Christopher T. Kent
*Attorney, Agent, or Firm*—Nawrocki, Rooney & Sivertson, P.A.

[57] ABSTRACT

A deck panel for reinforced concrete slabs is disclosed. The deck panel is formed by integrating a plurality of deck girders with a deck plate into a single structure. In each of the deck girders, a single lattice member is welded to upper and lower steel bars. The lattice member has a zigzag configuration with both a plurality of holding rib parts and a plurality of horizontal foot parts. The lattice member is positioned relative to the upper and lower steel bars in a way such that the holding rib parts, individually having a foot part, are alternately positioned on opposite sides of the upper and lower steel bars. A vertical fixing steel bar is welded to each end of the deck girder with both the top end of the fixing steel bar being welded to the upper steel bar and the middle portion of the fixing steel bar being welded to the lower steel bar.

4 Claims, 5 Drawing Sheets

DECK PANEL FOR REINFORCED CONCRETE SLABS

BACKGROUND OF THE INVENTION

1. Field of the Invention

The present invention relates, in general, to a deck panel for reinforced concrete slabs and, more particularly, to a deck panel formed by welding a plurality of deck girders onto a deck plate prior to being laid on iron beams or reinforced concrete beams, thus accomplishing both a concrete slab forming work and a surface finishing work at the same time while conserving the material of the slab structure and increasing the welding strength of the deck panel.

2. Description of the Prior Art

As well known to those skilled in the art, a reinforced concrete structure is formed using both concrete as a compression member and a plurality of steel bars as tension members, thus having a complex construction. In order to form such a reinforced concrete structure, a plurality of cast panels are arranged on a support surface with a desirable gap being defined between the cast panels. Thereafter, a plurality of steel bars are appropriately arrayed inside the gap. After arraying the steel bars inside the gap between the panels, concrete is poured into the gap and is hardened for a time so that the concrete is integrated with the steel bars into a single reinforced concrete structure. After the reinforced concrete structure is completely hardened, the cast panels are removed from the structure one by one, thus providing a desired reinforced concrete structure. Such a reinforced concrete structure is typically and preferably used as a building structure.

The typical process of forming such a reinforced concrete structure must include several steps of arraying the cast panels, such as wood panels, on a support surface and arraying a plurality of steel bars inside the gap between the panels. The process also includes a panel separation step of removing the cast panels from a reinforced concrete structure after the structure is completely hardened. That is, the process of forming a reinforced concrete structure using the cast panels includes a plurality of steps so that the process is time consuming.

Typically, the cast panels strongly adhere to the surfaces of the reinforced concrete structure and so it is very difficult to remove the panels from the structure. In addition, the cast panels cause uneven surfaces to remain on the reinforced concrete structure, thus causing the structure to be subjected to an additional surface finishing work. The cast panels are typically formed of a low strength material such as wood so that the panels may be unexpectedly damaged or broken when they are forcibly removed from a reinforced concrete structure. Such damaged panels cannot be repeatedly used so that they force the owner to purchase new ones at excessive costs and generate a large amount of waste panels.

In an effort to overcome such a problem experienced in the process of forming a reinforced concrete structure using the cast panels, a panel-free process, using a finishing member being integrated with concrete into a reinforced concrete structure, is proposed.

A deck plate process, which uses a corrugated deck plate in place of such cast panels, is a representative example of the known panel-free process. In such a deck plate process, a deck plate is simply laid on beams and so the process is free from the steps of arraying and removing the cast panels. Another advantage of the deck plate process resides in that the deck plate provides a safety working platform for workers thus eliminating the need for a typical safety net from the construction area. Such a deck plate remarkably simplifies the process of forming a reinforced concrete structure and shortens the construction time.

However, such a typical deck plate process is only free from the steps of arraying and removing the cast panels, but the deck plate process still requires the use of steel bars in order to provide a desired reinforcing strength of a concrete slab structure and securely integrate the flat deck plate with concrete, thus failing to radically simplify the process of forming a reinforced concrete structure.

In order to overcome the problems experienced in the typical deck plate process, several technologies are proposed and used.

FIG. 1 shows an embodiment of typical deck panels used in the process of forming a reinforced concrete slab structure. In order to form the deck panel of FIG. 1, three steel bars, one upper steel bar 12 and two lower steel bars 14, are welded to each other using two oppositely-arranged lattice members 15, thus forming a deck girder 10. A plurality of deck girders 10 are, thereafter, welded to a deck plate 20, thus forming a deck panel. In order to form a reinforced concrete slab using such a deck panel, the deck panel is laid on beams H prior to pouring concrete onto the deck panel. When the concrete is completely hardened, the concrete is securely integrated with the deck panel into a single reinforced concrete slab. In this case, the deck plate 20 forms a surface finishing member of the resulting reinforced concrete slab, thereby allowing the process to be free from any additional arrangement of steel bars, shortening construction time, conserving construction costs and improving work efficiency while forming reinforced concrete slabs.

However, the above deck girder 10 is formed by welding one upper steel bar 12 and two lower steel bars 14 to each other using two lattice members 15. The deck girder 10 thus regrettably wastes such lattice members 15. In addition, the three steel bars 12 and 14 and the two lattice members 15 have to be welded to each other into a deck girder 10, thereby deteriorating work efficiency and increasing construction costs while forming reinforced concrete slabs. Another problem of the above deck panel resides in that the deck girder 10 forms a space between the two lattice members 15. Since concrete cannot easily flow into the space, it is necessary to forcibly push the concrete into the space, thus reducing work efficiency while forming reinforced concrete slabs.

FIG. 2 shows another embodiment of typical deck panels used in the process of forming a reinforced concrete slab structure. In order to form the deck panel of FIG. 2, one upper steel bar 12 is welded to one lower steel bar 14 using one longitudinal lattice member 15, thus forming a deck girder 10. In the deck girder 10, the top bent portions of the lattice member 15 are welded to the upper steel bar 12, while the bottom bent portions are welded to the lower steel bar 14. A plurality of deck girders 10 are, thereafter, welded to a deck plate 20 and are reinforced by a plurality of transverse lattice members 17, thus forming a deck panel. In comparison with the deck panel of FIG. 1, the deck panel of FIG. 2 conserves the lattice members 15 and allows concrete to easily flow onto the deck panel. However, in the above deck panel, the longitudinal lattice member 15 has to be welded to the upper and lower steel bars 12 and 14 at several points, thereby reducing work efficiency while forming a reinforced concrete slab. In addition, the welding junction between the deck girder 10 and the deck plate 20 is small in area and reduces the welding strength of the deck panel. The above deck panel is also provided with a plurality of transverse lattice members 17 for reinforcing the deck girders 10, thus consuming the material of the lattice members 17 and reducing work efficiency and welding strength while welding the deck girders 10, transverse lattice members 17 and deck plate 20 to each other into a deck panel.

SUMMARY OF THE INVENTION

Accordingly, the present invention has been made keeping in mind the above problems occurring in the prior art, and an object of the present invention is to provide a deck panel for reinforced concrete slabs, of which a deck girder is formed by welding upper and lower steel bars to each other using a single lattice member passing by the steel bars through a zigzag passage and being welded to the bars, thus conserving the lattice members, improving work efficiency during a welding process and increasing the welding strength of the deck panel.

Another object of the present invention is to provide a deck panel for reinforced concrete slabs, which improves work efficiency when the deck panel is laid on iron beams or reinforced concrete beams and improves the structural strength of a resulting reinforced concrete slab.

In order to accomplish the above objects, the present invention provide a deck panel for reinforced concrete slabs, comprising: a deck plate and a plurality of deck girders regularly welded to the top surface of the deck plate. Each of the deck girders comprises: upper and lower steel bars; a single lattice member welded to the upper and lower steel bars, thus being integrated with the two steel bars into a single structure, the lattice member having a zigzag configuration with both a plurality of holding rib parts and a plurality of horizontal foot parts and being positioned relative to the upper and lower steel bars in a way such that the holding rib parts, individually having a horizontal foot part, are alternately positioned on opposite sides of the upper and lower steel bars; and a vertical fixing steel bar welded to each end of the deck girder with both the top end of the fixing steel bar being welded to the upper steel bar and the middle portion of the fixing steel bar being welded to the lower steel bar.

BRIEF DESCRIPTION OF THE DRAWINGS

The above and other objects, features and other advantages of the present invention will be more clearly understood from the following detailed description taken in conjunction with the accompanying drawings, in which:

FIGS. 3 and 4 are perspective views showing the construction of deck girders for deck panels in accordance with the primary embodiment of the present invention, in which:

FIG. 3 shows a deck girder with a linear vertical fixing steel bar being provided at each end; and FIG. 4 shows a deck girder with a bent vertical fixing steel bar being provided at each end;

DESCRIPTION OF THE PREFERRED EMBODIMENTS

As shown in FIGS. 3, 4, 7 and 8, a deck panel for reinforced concrete slabs in accordance with this invention is formed by integrating a plurality of deck girders 10 with a deck plate 20 into a single structure through a welding process.

Figure 3:
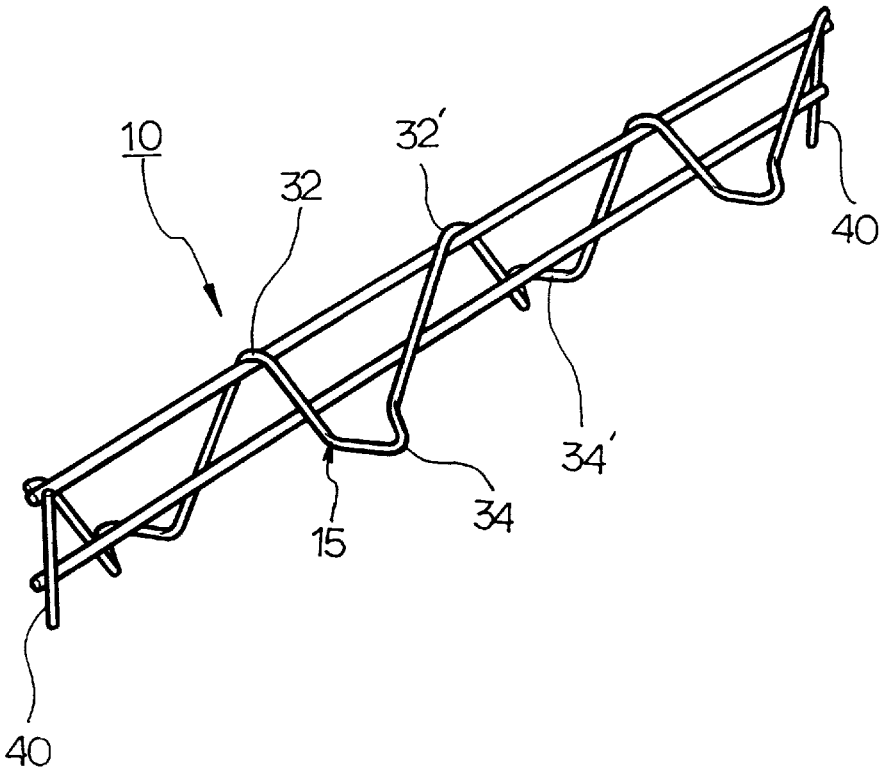
Figure 4:
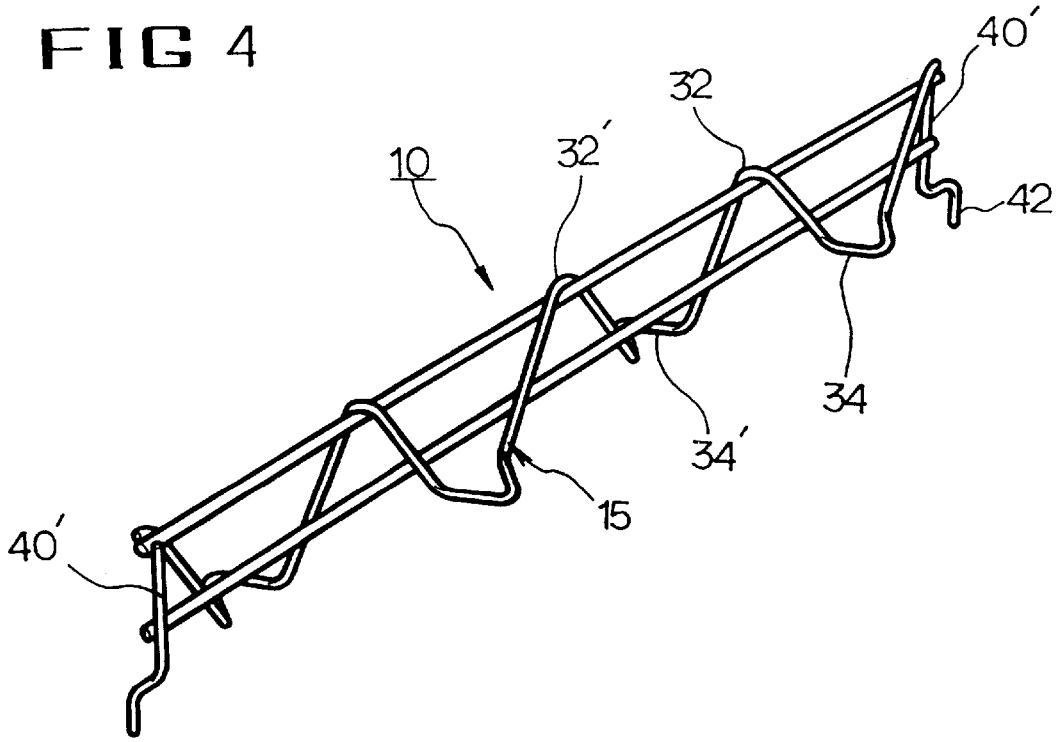

In the embodiments of FIGS. 3 and 4, each of the deck girders 10 is formed by welding upper and lower steel bars 12 and 14 to each other using a single lattice member 15. The lattice member 15 is zigzagged into a specified configuration having both a plurality of holding rib parts 32 and 32' and a plurality of horizontal foot parts 34 and 34'. In the lattice member 15, the rib parts 32 and 32' are individually bent into a ridge configuration with two ribs, while the foot parts 34 and 34' are formed between the rib parts 32 and 32'. The lattice member 15 is positioned relative to and welded to the upper and lower steel bars 12 and 14, with the rib parts 32 and 32' obliquely passing over the upper steel bars 12 and the two ribs of each rib part 32, 32' obliquely extending on opposite sides of the two steel bars 12 and 14.

In such a case, the foot parts 34 and 34' are thus alternately positioned on opposite sides of the lower steel bar 14.

The deck girder 10 also has a vertical fixing steel bar 40, 40', which is welded to at least one of both ends of the deck girder 10, as shown in FIGS. 3 and 4. That is, a vertical fixing steel bar 40, 40' is welded to the upper steel bar 12 at the top end and is welded to the lower steel bar 14 at the middle portion. The vertical fixing steel bar 40 according to the primary embodiment of this invention has a linear configuration as shown in FIG. 3, while the vertical fixing steel bar 40' according to the second embodiment of this invention has a bent part 42 at the lower portion as shown in FIG. 4. It should be understood that the two types of fixing steel bars 40 and 40' yield the same operational function even though they are different from each other in their configuration.

Figure 7:
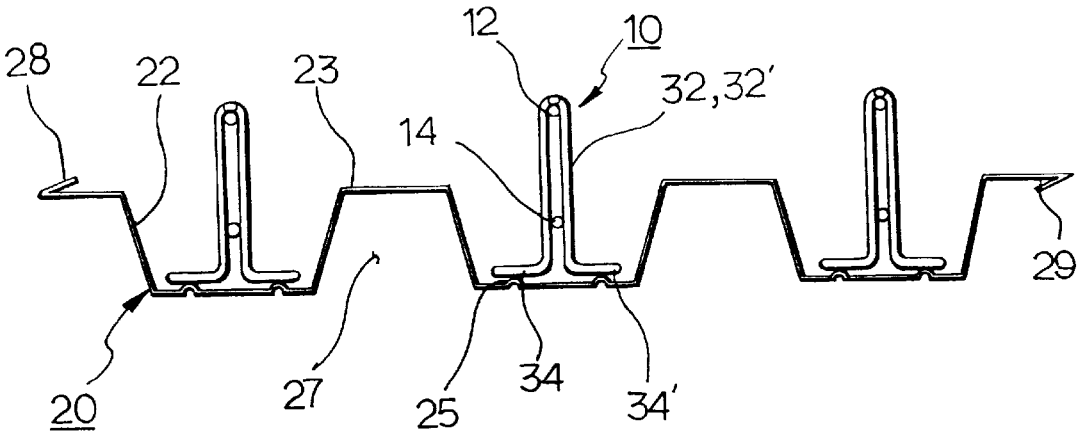
FIG. 7 is a side view showing the construction of a deck panel in accordance with an embodiment of the present invention.
Figure 8:
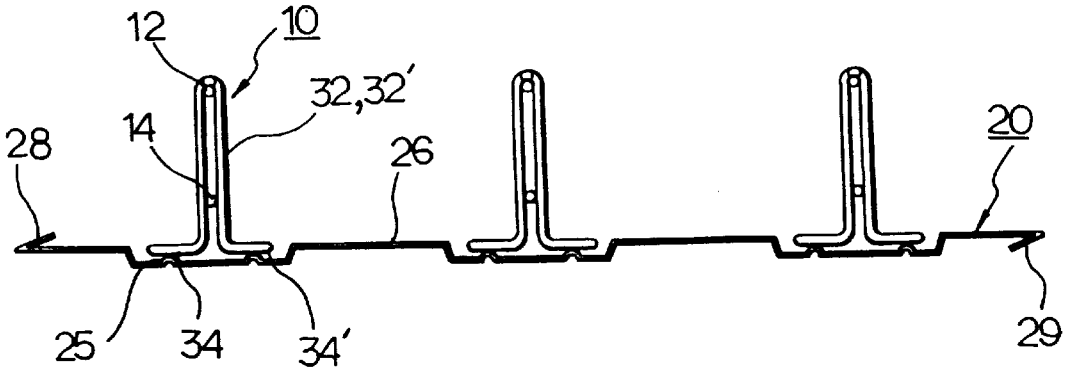
FIG. 8 is a side view showing the construction of a deck panel in accordance with another embodiment of the present invention.

After the deck girder forming process, each of the deck girders 10 is welded to a deck plate 20, thus forming a deck panel. The above deck plate 20 is preferably made of a high corrosion resistant material and has a corrugated cross-section. That is, the deck plate 20 is provided with a plurality of grooves and ridges which are alternately and longitudinally formed on the plate 20. In the embodiment of FIG. 7, the deck plate 20 is provided with a plurality of deep grooves 22 and high ridges 23. In such a case, each of the deep grooves 22 has a plurality of beads 25 on the top surface and supports a deck girder 10, which is longitudinally positioned in the groove 22 and is welded to the beads 25. In another embodiment of this invention, the corrugated configuration of the deck plate 20 may be formed by a plurality of shallow grooves 25 and low ridges 26 as shown in FIG. 8. In such a case, each of the grooves 25 has a plurality of beads on the top surface, thus allowing a deck girder 10 to be welded to the beads of the grooves 25 in the same manner as described for the embodiment of FIG. 7.

Figure 5:
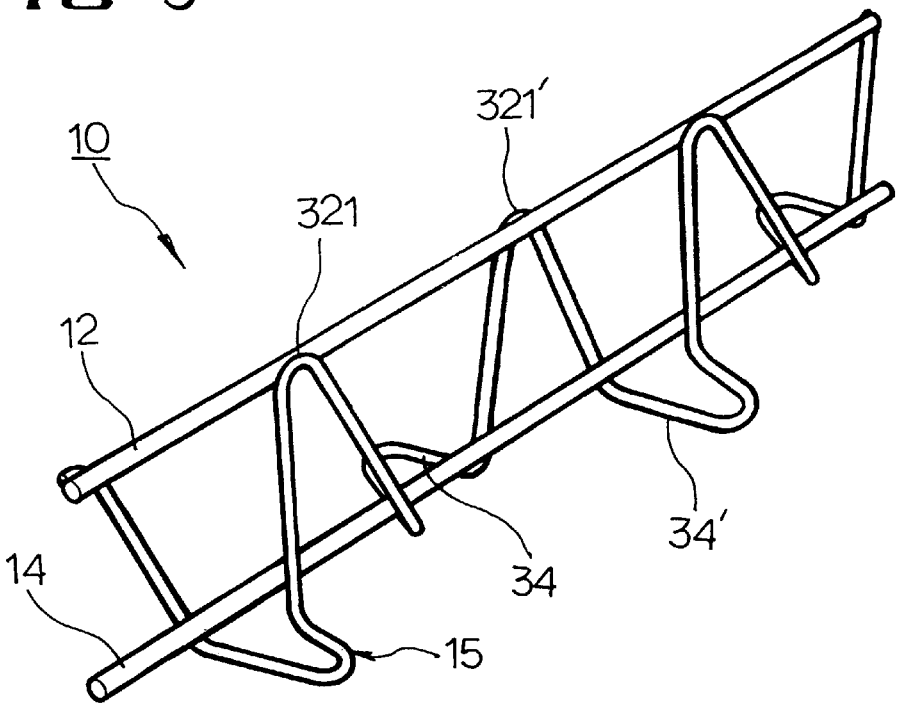
FIG. 5 is a perspective view showing the construction of a deck girder in accordance with another embodiment of the present invention.
Figure 6:
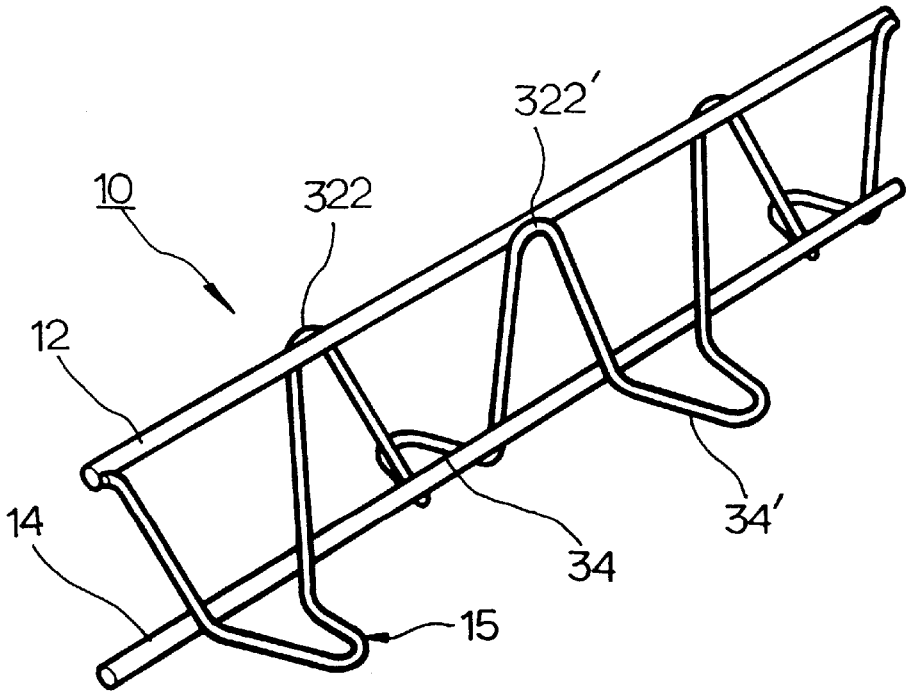
FIG. 6 is a perspective view showing the construction of a deck girder in accordance with a further embodiment of the present invention.

FIGS. 5 and 6 show deck girders 10 in accordance with third and fourth embodiments of this invention. In the deck girder of FIG. 5, a single lattice member 15 is zigzagged into a specified configuration having both a plurality of holding rib parts 321 and 321' and a plurality of horizontal foot parts 34 and 34'. The rib parts 321 and 321' and the foot parts 34 and 34' are alternately formed on the single lattice member 15. The lattice member 15 is positioned relative to the upper and lower steel bars 12 and 14, with the holding rib parts 321 and 321' being alternately positioned on opposite sides of the two steel bars 12 and 14. In such a case, the junction between a rib part 321, 321' and an associated foot part 34, 34' obliquely passes under the lower steel bar 14, thus allowing the foot parts 34 and 34' to be alternately positioned on opposite sides of the lower steel bar 14. Meanwhile, in the embodiment of FIG. 6, the zigzag lattice member 15 is positioned relative to the upper and lower steel bars 12 and 14 with the foot parts 34 and 34' being alternately positioned on opposite sides of the lower steel bar 14. In such a case, one rib of each rib part 322, 322' obliquely passes from one side of the two steel bars 12 and 14 to the other side through the gap between the two steel bars 12 and 14, while the other rib obliquely extends on the other side.

In the drawings, the reference numerals 28 and 29 denote lap parts, which are provided at both side edges of the deck plate 20 and allow the deck plate 20 to be coupled to a neighboring deck plate 20. The reference numeral 27 denotes a duct used for receiving various wires and pipes.

The operational effect of the deck panel according to this invention will be described hereinbelow.

In the deck panel according to the primary embodiment of this invention, each of the deck girders 10 is formed by welding upper and lower steel bars 12 and 14 to each other using one lattice member 15. The lattice member 15 is zigzagged, thus having both the holding rib parts 32 and 32' and the foot parts 34 and 34'. The lattice member 15 is positioned relative to and welded to the upper and lower steel bars 12 and 14, with the rib parts 32 and 32' obliquely passing over the upper steel bars 12, thus allowing the two ribs of each rib part 32, 32' to obliquely extend on opposite sides of the two steel bars 12 and 14 and allowing the foot parts 34 and 34' to be alternately positioned on opposite sides of the lower steel bar 14. Therefore, the deck panel of this invention effectively conserves the lattice member 15 and enlarges the welded area between the two steel bars 12 and 14 and the lattice member 15, thus increasing the welding strength at the welded area.

Figure 1:
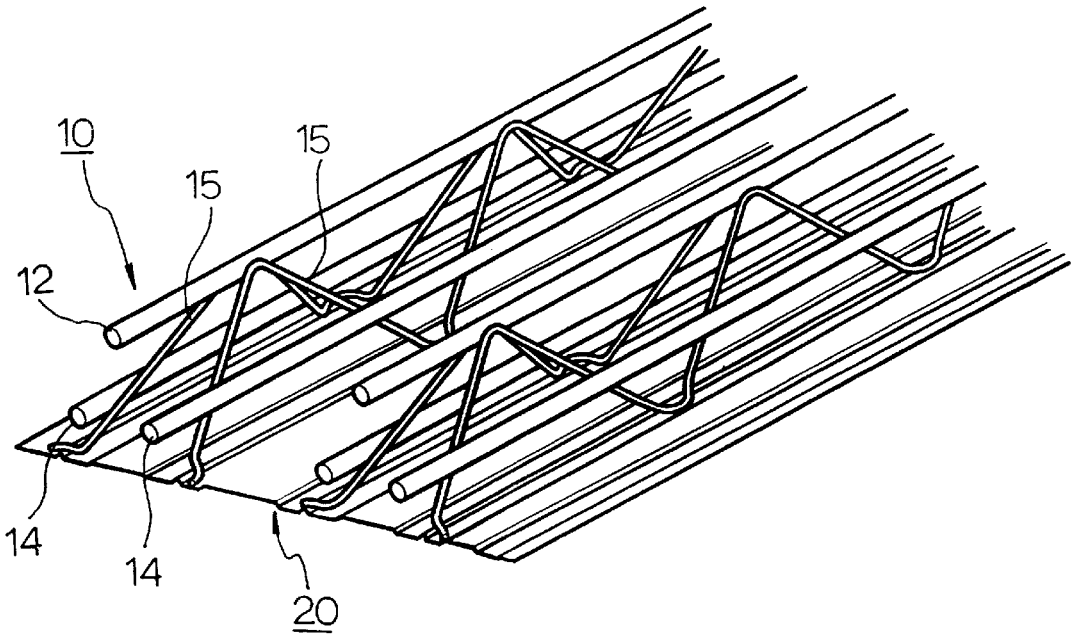
FIG. 1 is a perspective view showing the construction of a deck panel for reinforced concrete slabs in accordance with an embodiment of the prior art.
Figure 2:
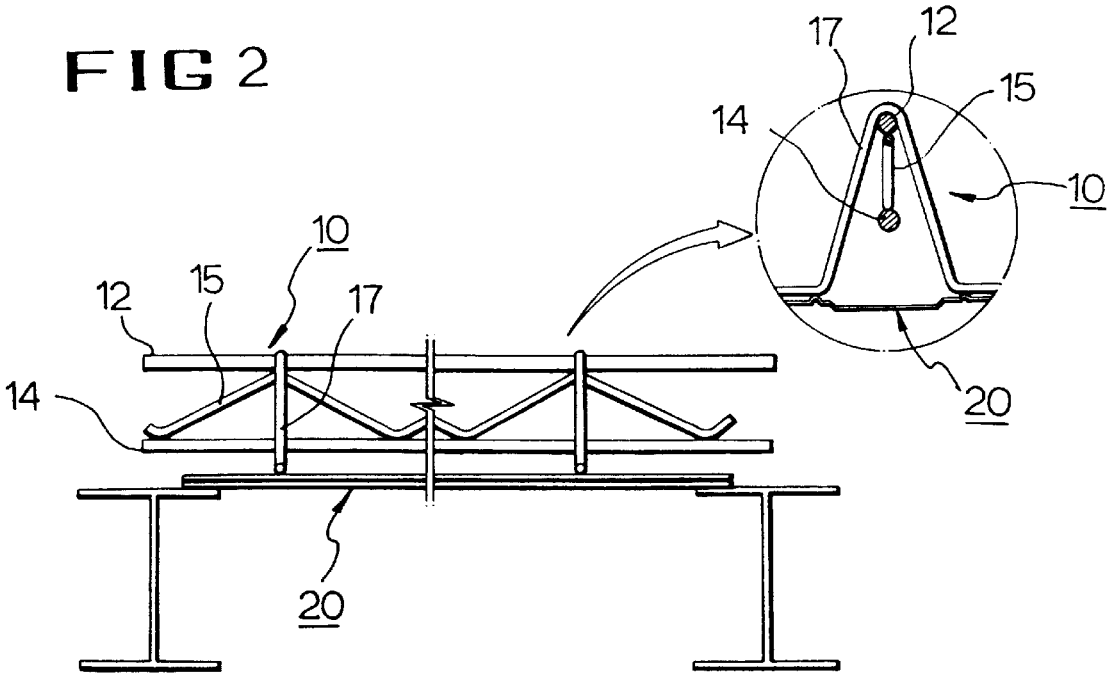
FIG. 2 is a front view showing the construction of a deck panel for reinforced concrete slabs in accordance with another embodiment of the prior art.

The above deck girder 10 is welded to the deck plate 20 at the horizontally positioned foot parts 34 and 34' of the lattice member 15, thus enlarging the welded area between the girder 10 and the plate 20 and increasing the welding strength at the welded area. Therefore, the deck girder 10 is strongly welded to the deck plate 20 without using any additional lattice member 17, thus conserving such a lattice member 17 different from the typical deck panel of FIG. 2.

In the deck girders 10 of FIGS. 5 and 6, one lattice member 15 is welded to the upper and lower steel bars 12 and 14, with both the holding rib parts and foot parts of the lattice member 15 being alternately positioned on opposite sides of the two steel bars 12 and 14. In the embodiment of FIG. 5, the junctions between the rib parts and the foot parts of the lattice member 15 alternately pass under the lower steel bar 14, thus allowing both the holding rib parts and foot parts to be alternately positioned on opposite sides of the two steel bars 12 and 14. In the embodiment of FIG. 6, each rib part of the lattice member 15 passes from one side of the two steel bars 12 and 14 through the gap between the two steel bars 12 and 14, thus allowing the foot parts to be alternately positioned on opposite sides of the two steel bars 12 and 14. Each of the deck girders 10 of FIGS. 5 and 6 thus enlarges the welded area between the girder 10 and the deck plate 20 and increases the welding strength at the welded area. Therefore, the deck girder 10 is strongly welded to the deck plate 20 while conserving the lattice member 15.

The deck panels, which are formed by strongly welding the deck girders 10 according to different embodiments of this invention to deck plates 20, are selectively used in accordance with the types of beams H and H' of a frame structure.

Figure 9:
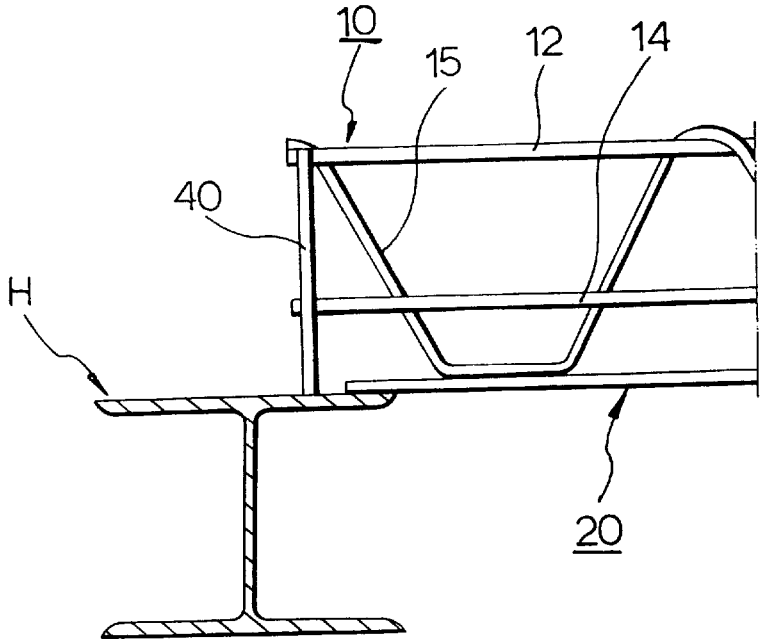
FIG. 9 is a side view showing a deck panel provided with the deck girder of FIG. 3 and laid on an iron beam.

That is, when the beams of a frame structure are iron beams H as shown in FIG. 9, the deck panel with a linear vertical fixing steel bar 40 is used. In such a case, one end of the deck panel is laid on an iron beam H, with the lower end of a vertical fixing steel bar 40 coming into contact with the top surface of the iron beam H prior to being welded to the beam H. Therefore, it is possible to simply and strongly install the deck panel on the iron beams H.

Of course, the other end of the deck panel is laid on another iron beam H prior to welding a vertical fixing steel bar 40 to the beam H.

Figure 10:
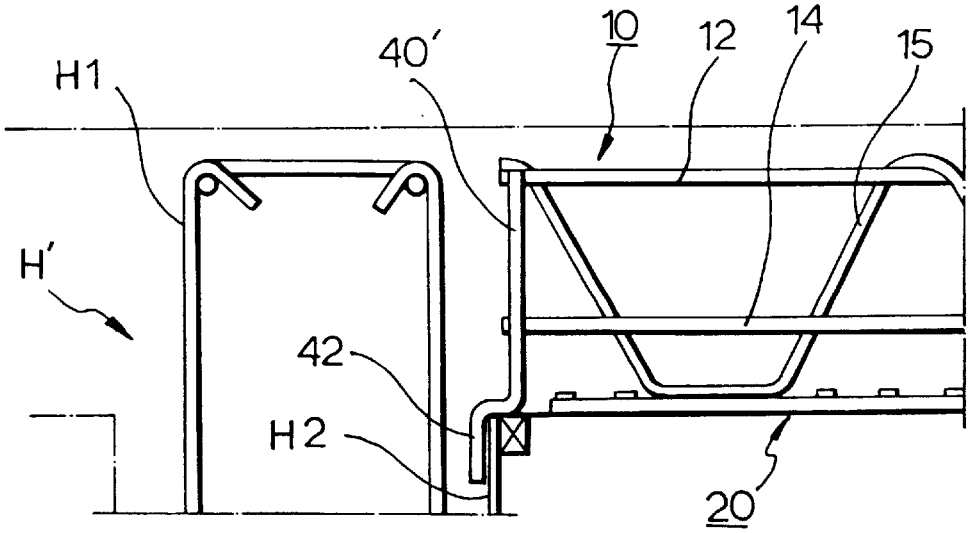
FIG. 10 is a side view showing a deck panel provided with the deck girder of FIG. 4 and laid on a reinforced concrete beam.

When the beams of a frame structure are reinforced concrete beams H' as shown in FIG. 10, the deck panel with a bent vertical fixing steel bar 40' is used. Since a reinforced concrete beam H' In the above state is comprised of a steel-frame structure H1 and cast panels H2 free from concrete, one end of the deck panel is easily and strongly installed on a reinforced concrete beam H' by seating the bent part 42 of a fixing steel bar 40' on the steel-frame structure H1 or a cast panel H2.

Of course, the other end of the deck panel is laid on another reinforced concrete beam H' prior to welding a fixing steel bar 40' to the beam H'.

After a deck panel is installed on beams H, H', a steel net is installed on the deck panel prior to pouring concrete into the gap defined by both the deck panel and the steel net and hardening the concrete for a time. The concrete is integrated with the deck panel, thus allowing the top portion of the deck panel with the deck girders 10 to form a reinforced concrete slab and allowing the deck plate 20 to form a surface finishing member of the resulting reinforced concrete slab.

As described above, the present invention provides a deck panel for reinforced concrete slabs. The deck panel is formed by integrating a plurality of deck girders with a deck plate into a single structure through a welding process. In each of the deck girders, a single lattice member is welded to upper and lower steel bars, thus being integrated with the two steel bars into a single structure. The lattice member has a zigzag configuration with both a plurality of holding rib parts and a plurality of horizontal foot parts. The lattice member is positioned relative to the upper and lower steel bars in a way such that the holding rib parts, individually having a horizontal foot part, are alternately positioned on opposite sides of the upper and lower steel bars. A vertical fixing steel bar is welded to each end of the deck girder with both the top end of the fixing steel bar being welded to the upper steel bar and the middle portion of the fixing steel bar being welded to the lower steel bar. The deck panel of this invention thus conserves the lattice members, improves work efficiency during a welding process and increases the welding strength of the deck panel. Another advantage of the deck panel of this invention resides in that it improves work efficiency when the deck panel is laid on iron beams or reinforced concrete beams and improves the structural strength of a resulting reinforced concrete slab.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A deck panel for reinforced concrete slabs, comprising:

a deck plate; and a plurality of deck girders regularly welded to the top surface of said deck plate, each of said deck girders comprising:

upper and lower steel bars;

a single lattice member welded to said upper and lower steel bars, thus being integrated with the two steel bars into a single structure, said lattice member having a zigzag configuration with both a plurality of holding rib parts and a plurality of horizontal foot parts and being positioned relative to the upper and lower steel bars in a way such that the holding rib parts, individually having a horizontal foot part, are alternately positioned on opposite sides of the upper and lower steel bars; and a vertical fixing steel bar welded to each end of the deck girder with both the top end of the fixing steel bar being welded to the upper steel bar and the middle portion of the fixing steel bar being welded to the lower steel bar.

2. The deck panel according to claim 1, wherein said vertical fixing steel bar is bent at the lower portion, thus forming a bent part.

3. The deck panel according to claim 1, wherein said lattice member obliquely passes under the lower steel bar at a junction between each of the rib parts and an associated foot part, the holding rib parts, individually having a horizontal foot part, being alternately positioned on opposite sides of the upper and lower steel bars.

4. The deck panel according to claim 1, wherein each of said rib parts of the lattice member obliquely passes from one side of the upper and lower steel bars to the other side through a gap between the two steel bars and so the rib parts, individually having a horizontal foot part, are alternately positioned on opposite sides of the upper and lower steel bars.

* * * * *